US007186099B2

(12) United States Patent
Elson et al.

(10) Patent No.: US 7,186,099 B2
(45) Date of Patent: Mar. 6, 2007

(54) INCLINED SCROLL MACHINE HAVING A SPECIAL OIL SUMP

(75) Inventors: John P Elson, Sidney, OH (US); Brian R Butler, Centerville, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 128 days.

(21) Appl. No.: 11/046,573

(22) Filed: Jan. 28, 2005

(65) Prior Publication Data

US 2006/0171831 A1 Aug. 3, 2006

(51) Int. Cl.
*F01C 1/04* (2006.01)
*F01C 21/06* (2006.01)
*F01C 21/04* (2006.01)

(52) U.S. Cl. ..... 418/55.6; 418/55.3; 418/91; 418/92

(58) Field of Classification Search ..... 418/55.3, 418/55.6, 91, 92
See application file for complete search history.

(56) References Cited

U.S. PATENT DOCUMENTS

| | | | | |
|---|---|---|---|---|
| 3,462,072 | A | 8/1969 | Schibbye | 418/98 |
| 3,777,509 | A | 12/1973 | Muench | 62/470 |
| 3,796,526 | A | 3/1974 | Cawley | 418/97 |
| 3,945,216 | A | 3/1976 | Schibbye | 62/84 |
| 4,080,119 | A | 3/1978 | Eriksson | 418/97 |
| 4,112,701 | A | 9/1978 | Schibbye et al. | 62/84 |
| 4,140,337 | A | 2/1979 | Arcella et al. | 285/3 |
| 4,289,334 | A | 9/1981 | Riley | 285/55 |
| 4,312,187 | A | 1/1982 | Myers | 62/84 |
| 4,343,599 | A | 8/1982 | Kousokabe | 418/55.6 |
| 4,400,020 | A | 8/1983 | Keller | 285/204 |
| 4,420,293 | A | 12/1983 | Hofmann | 418/47 |
| 4,439,121 | A | 3/1984 | Shaw | 418/98 |
| 4,449,895 | A | 5/1984 | Kurahayashi | 417/368 |
| 4,456,437 | A | 6/1984 | Kurahayashi et al. | 417/368 |
| 4,470,772 | A | 9/1984 | Gannaway | 417/368 |
| 4,676,075 | A | 6/1987 | Shiibayashi | 62/469 |
| 4,758,136 | A | 7/1988 | Pamlin et al. | 418/15 |
| 4,818,198 | A | 4/1989 | Tamura et al. | 418/55.6 |
| 4,877,382 | A * | 10/1989 | Caillat et al. | 418/55.5 |
| 4,895,498 | A | 1/1990 | Basseggio | 417/426 |
| 4,898,521 | A | 2/1990 | Sakurai et al. | 418/55.6 |
| 4,917,582 | A | 4/1990 | Fraser, Jr. et al. | 418/55.3 |
| 4,946,361 | A | 8/1990 | DeBlois et al. | 418/55.6 |
| 5,027,606 | A | 7/1991 | Short | 62/84 |
| 5,040,382 | A | 8/1991 | Abraham | 62/470 |

(Continued)

FOREIGN PATENT DOCUMENTS

| | | |
|---|---|---|
| JP | 11-082340 | 3/1999 |

*Primary Examiner*—Thomas Denion
*Assistant Examiner*—Mary A. Davis
(74) *Attorney, Agent, or Firm*—Harness, Dickey & Pierce, P.L.C.

(57) ABSTRACT

A scroll-type compressor is provided in an inclined or inverted position with an oil sump disposed adjacent to a gas inlet of the scroll wraps to allow droplets of oil to be entrained in the gas being compressed so that the oil droplets in the gas can cool the scroll wraps. An oil injection fitting also extends through the compressor shell and communicates lubricating oil to a lubrication passage in the crankshaft for providing lubricant to the bearings of the crankshaft of the compressor and other components. The oil injection fitting is supplied with lubricant from an externally disposed source.

10 Claims, 5 Drawing Sheets

U.S. PATENT DOCUMENTS 5,076,771 A 12/1991 Ban et al. ..... 418/55.4
5,110,268 A 5/1992 Sakurai et al. ..... 417/410.5
5,112,201 A 5/1992 Tamura et al. ..... 417/336
5,131,497 A 7/1992 Rogers ..... 184/1.5
5,137,437 A 8/1992 Machida et al. ..... 418/55.1
5,197,868 A 3/1993 Caillat et al. ..... 418/55.5
5,246,357 A 9/1993 Sjoholm et al. ..... 418/97
5,256,042 A * 10/1993 McCullough et al. ..... 418/1
5,277,564 A 1/1994 Tamura et al. ..... 418/55.6
5,320,506 A * 6/1994 Fogt ..... 418/55.3
5,328,340 A 7/1994 Hara et al. ..... 418/55.1
5,345,785 A 9/1994 Sekigami et al. ..... 62/468
5,358,392 A 10/1994 Ukai ..... 418/55.6
5,370,513 A 12/1994 Fain ..... 418/55.6
5,391,066 A 2/1995 Sawai et al. ..... 418/55.6
5,445,507 A 8/1995 Nakamura et al. ..... 418/55.1
5,466,136 A 11/1995 Yamada et al. ..... 418/55.6
5,494,422 A 2/1996 Ukai et al. ..... 418/55.1
5,580,230 A 12/1996 Keifer et al. ..... 418/55.5
5,580,233 A 12/1996 Wakana et al. ..... 418/94
5,591,018 A 1/1997 Takeuchi et al. ..... 417/366
5,634,345 A 6/1997 Alsenz ..... 62/84
5,645,408 A 7/1997 Fujio et al. ..... 418/55.4
5,660,539 A 8/1997 Matsunaga et al. ..... 418/55.6
5,683,237 A 11/1997 Hagiwara et al. ..... 418/55.2
5,685,168 A 11/1997 Sada ..... 62/473
5,735,139 A 4/1998 Lord et al. ..... 62/470
5,810,572 A 9/1998 Yamamoto et al. ..... 418/55.6
5,931,650 A 8/1999 Yasu et al. ..... 418/55.3
6,017,205 A 1/2000 Weatherston ..... 418/55.6
6,086,343 A * 7/2000 Sun et al. ..... 418/55.6
6,167,719 B1 1/2001 Yakumaru et al. ..... 62/468
6,183,227 B1 2/2001 Hida et al. ..... 418/55.6
6,273,693 B2 8/2001 Hida et al. ..... 418/55.6
6,322,339 B1 11/2001 Mitsunaga et al. ..... 418/55.2
6,422,844 B2 7/2002 Hioki et al. ..... 418/98
6,428,296 B1 * 8/2002 Elson et al. ..... 418/55.6
6,478,557 B2 11/2002 Shiibayashi et al. ..... 418/55.2
6,499,967 B2 12/2002 Hansen ..... 417/365
6,506,039 B1 1/2003 Osumimoto et al. ..... 418/201.1
6,511,297 B2 * 1/2003 Ota et al. ..... 417/222.2
6,672,102 B1 1/2004 Huenniger et al. ..... 62/472
6,739,147 B1 5/2004 Sishtla ..... 62/192
6,758,660 B2 7/2004 Kriehn et al. ..... 418/91
2001/0000320 A1 4/2001 Hida et al. ..... 418/201.1
2001/0036417 A1 11/2001 Hioki et al. ..... 418/98
2002/0054823 A1 5/2002 Hida et al. ..... 418/201.2
2002/0159907 A1 10/2002 Kammhoff et al. ..... 418/201.1
2002/0187064 A1 12/2002 Vigano et al. ..... 418/201.3
2003/0021714 A1 1/2003 Osumimoto et al. ..... 418/201.1
2004/0184941 A1 9/2004 Aoki et al. ..... 418/84
2004/0208771 A1 10/2004 Ohsumimoto et al. ... 418/201.1

* cited by examiner

INCLINED SCROLL MACHINE HAVING A SPECIAL OIL SUMP

FIELD OF THE INVENTION

The present invention relates generally to scroll-type machines. More particularly, the present invention relates to a scroll-type compressor having an oil sump adjacent to the scroll wraps

BACKGROUND AND SUMMARY OF THE INVENTION

Scroll machines in general, and particularly scroll compressors, are often disposed in a hermetic shell which defines a chamber within which is disposed a working fluid. A partition within the shell often divides the chamber into a discharge pressure zone and a suction pressure zone. In a low-side arrangement, a scroll assembly is located within the suction pressure zone for compressing the working fluid. Generally, these scroll assemblies incorporate a pair of intermeshed spiral wraps, one or both of which are caused to orbit relative to the other so as to define one or more moving chambers which progressively decrease in size as they travel from an outer suction port towards a center discharge port. An electric motor is normally provided which operates to cause this relative orbital movement.

The partition within the shell allows compressed fluid exiting the center discharge port of the scroll assembly to enter the discharge pressure zone within the shell while simultaneously maintaining the integrity between the discharge pressure zone and the suction pressure zone. This function of the partition is normally accomplished by a seal which interacts with the partition and with the scroll member defining the center discharge port.

The discharge pressure zone of the hermetic shell is normally provided with a discharge fluid port which communicates with a refrigeration circuit or some other type of fluid circuit. In a closed system, the opposite end of the fluid circuit is connected with the suction pressure zone of the hermetic shell using a suction fluid port extending through the shell into the suction pressure zone. Thus, the scroll machine receives the working fluid from the suction pressure zone of the hermetic shell, compresses the working fluid in the one or more moving chambers defined by the scroll assembly, and then discharges the compressed working fluid into the discharge pressure zone of the compressor. The compressed working fluid is directed through the discharge port through the fluid circuit and returns to the suction pressure zone of the hermetic shell through the suction port.

Typically, scroll-type compressors have been designed as either a vertical or a horizontal scroll compressor. A primary difference between the vertical and horizontal scroll compressor designs stems from the fact that the lubrication sump and delivery systems have needed to be specifically adapted for a vertical or horizontal configuration. Commonly assigned U.S. Pat. No. 6,428,296 discloses a typical vertical-type scroll compressor modified to be a horizontal-type scroll compressor by providing a unique oil injection fitting for delivering oil to the existing lubricant passage in the crank shaft of the compressor system from an external oil source. The present invention provides a negatively inclined or inverted scroll compressor wherein the muffler/partition plate defines part of the oil sump within the hermetic shell. The ability to incline or invert the scroll compressor allows the amount of oil accumulated in the sump to be reduced and allows oil in the sump to be directly ingested through the scroll wraps for cooling of the wraps. Furthermore, space constraints within the surrounding environment may dictate whether the compressor needs to be disposed in an inclined or vertical position.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
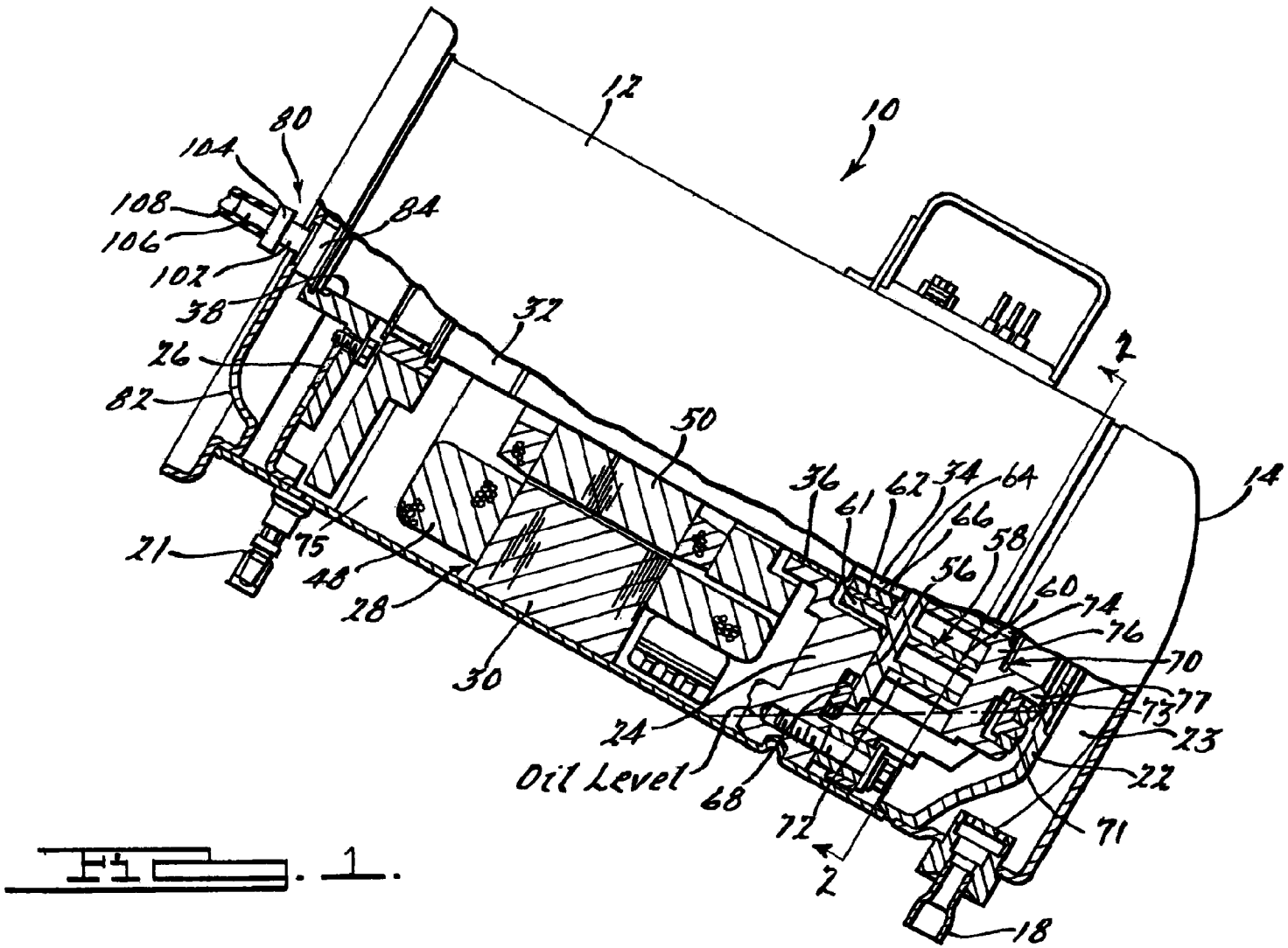
FIG. 1 is a vertical sectional view through the center of a negatively inclined scroll compressor in accordance with the present invention.

While the present invention is suitable for incorporation with many different types of scroll machines, for exemplary purposes, it will be described herein incorporated in a scroll compressor of the general structure illustrated in FIG. 1 (the vertical-type compressor shown prior to conversion to a negatively inclined compressor is a ZB45 compressor commercially available from Copeland Corporation, Sidney, Ohio.) Referring now to the drawings, and in particular to FIG. 1, a compressor 10 is shown which comprises a generally cylindrical hermetic shell 12 having welded at one end thereof a cap 14. Cap 14 is provided with a discharge fitting 18 which may have the usual discharge valve therein. Other major elements affixed to the shell include an inlet fitting 21, a transversely extending partition 22 which is welded about its periphery at the same point that cap 14 is welded to cylindrical shell 12. A discharge chamber 23 is defined by cap 14 and partition 22.

A main bearing housing 24 and a second bearing housing 26 having a plurality of radially outwardly extending legs are each secured to the cylindrical shell 12. A motor 28 which includes a stator 30 is supported within the cylindrical shell 12 between main bearing housing 24 and second bearing housing 26. A crank shaft 32 having an eccentric crank pin 34 at one end thereof is rotatably journaled in a bearing 36 in main bearing housing 24 and a second bearing 38 in second bearing housing 26.

Crank shaft 32 has, at a second end, a relatively large diameter concentric bore which communicates with a radially outwardly smaller diameter bore extending therefrom to the first end of crankshaft 32.

Crank shaft 32 is rotatably driven by electric motor 28 including rotor 50 and stator windings 48 passing therethrough. The rotor 50 is press fitted on crank shaft 32 and may include counterweights mounted thereon for balancing.

A first surface of the main bearing housing 24 is provided with a flat thrust bearing surface 56 against which is disposed an orbiting scroll 58 having the usual spiral vane or wrap 60 on a first surface thereof. Projecting from the second surface of orbiting scroll 58 is a cylindrical hub 61 having a journal bearing 62 therein in which is rotatably disposed a drive bushing 64 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference.

An oldham coupling 68 is disposed between orbiting scroll 58 and bearing housing 24. Oldham coupling 68 is keyed to orbiting scroll 58 and a non-orbiting orbiting scroll 70 to prevent rotational movement of orbiting scroll member 58. Oldham coupling 68 is preferably of the type disclosed in assignee's U.S. Pat. No. 5,320,506, the disclosure of which is hereby incorporated herein by reference. A floating seal 71 is supported by the non-orbiting scroll 70 and engages a seat portion 73 mounted to the partition 22 for sealingly dividing the intake and discharge chambers 75 and 23, respectively.

Non-orbiting scroll member 70 is provided having a wrap 72 positioned in meshing engagement with wrap 60 of orbiting scroll 58. Non-orbiting scroll 70 has a centrally disposed discharge passage 74 defined by a base plate portion 76. Non-orbiting scroll 70 also includes an annular hub portion 77 which surrounds the discharge passage 74. A dynamic discharge valve or read valve can be provided in the discharge passage 74.

Figure 7:
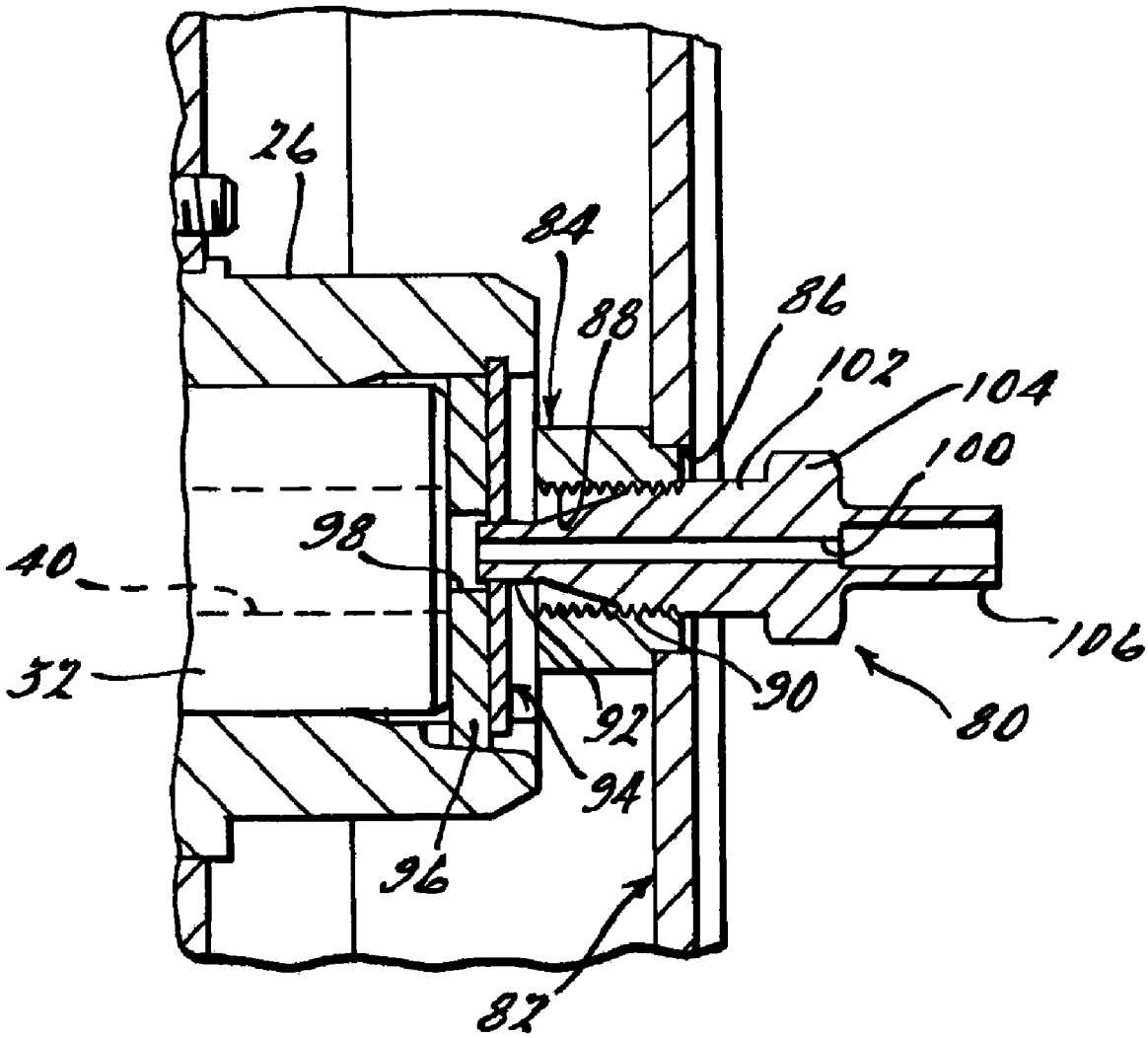
PRIOR ART FIG. 7.
FIG. 7 is a detailed cross-sectional view of the oil injection fitting supplying oil to the scroll compressor according to the present invention.

An oil injection fitting 80, as best shown in FIG. 7, is provided through the second cap 82 which is connected to the shell 12. The oil injection fitting 80 is threadedly connected to a fitting 84 which is welded within an opening 86 provided in the bottom cap 82. The fitting 84 includes an internally threaded portion 88 which is threadedly engaged by an externally threaded portion 90 provided at one end of the oil injection fitting 80. A nipple portion 92 extends from the externally threaded portion 90 of the oil injection fitting 80. The nipple portion 92 extends within an opening provided in a snap ring 94 which is disposed in the lower bearing housing 26. The snap ring 94 holds a disk member 96 in contact with the lower end of the crankshaft 32. Disk member 96 includes a hole 98 which receives, with a clearance, the end of the nipple portion 92 therein. The nipple portion 92 communicates with an internal lubrication passage 40 extending through the crankshaft 32. The oil injection fitting includes an internal oil passage 100 extending longitudinally therethrough which serves as a restriction on the oil flow. The oil injection fitting 80 includes a main body portion 102 which is provided with a tool engaging portion 104 (such as a hex shaped portion which facilitates the insertion and removal of the fitting 80 by a standard wrench). The oil injection fitting 80 further includes a second nipple portion 106 extending from the main body 102 in a direction opposite to the first nipple portion 92. The second nipple portion 106 is adapted to be engaged with a hose or tube 108 which supplies oil to the fitting 80. The oil that passes through the fitting 80 passes through the lubrication passage 40 and lubricates the bearings 36, 38 and accumulates in the compressor sump.

Figure 2:
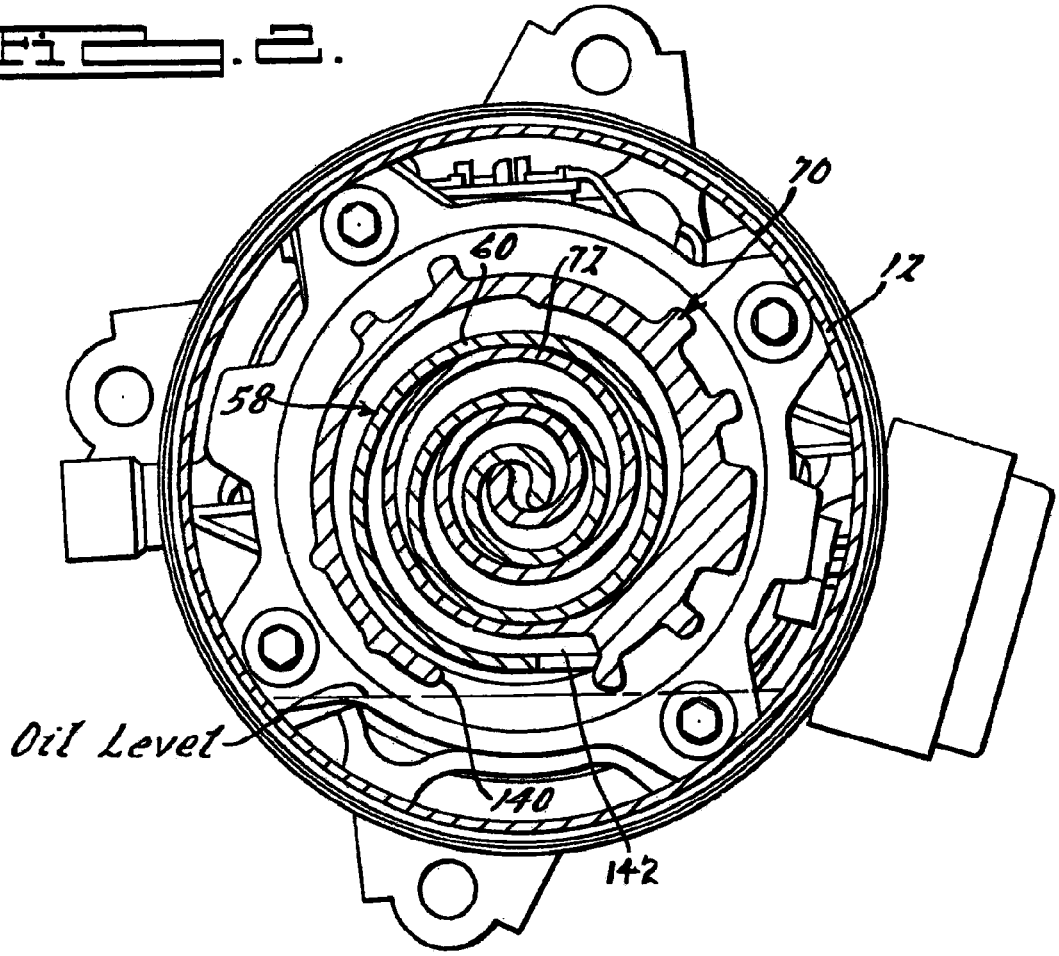
FIG. 2 is a cross-sectional view taken along line 2—2 of FIG. 1.

As shown in FIG. 1, the compressor 10 is negatively inclined so that the partition plate 22 defines part of the sump for receiving oil therein. The oil level is preferably disposed just below the gas inlet 140 provided on the lower side of the scroll members 58, 70 (best shown in FIG. 2) so that working fluid entering the scroll inlet 140 can entrain the oil for providing cooling and lubrication to the internal wraps of the scroll-type compressor. The oil level within the sump is self regulated such that as the oil level reaches the gas inlet 140, the oil is ingested into the inlet and subsequently expelled from the compressor to be separated, as will be described with reference to FIGS. 3–5. Furthermore, because the oil is in contact with the partition plate, the oil acts as a coolant on the partition plate. By maintaining the compressor 10 in an inclined position as illustrated in FIG. 1, the amount of oil needed to maintain the level close to the gas inlets 140, 142 of the scroll wraps can be minimized so that a reduced amount of oil needs to be maintained within the shell 12. The oil injection fitting 80 provides lubricant to the bearings 36, 38 for the crankshaft 32 via the internal oil passages in the crankshaft 32. The oil that is ingested through the gas inlet 140 of the scroll members 58, 70 and carried out through the discharge port is separated by an oil separator and may be cooled by a heat exchanger prior to being re-injected through oil fitting 80, as will be described in greater detail with respect to FIG. 3 below.

Figure 6:
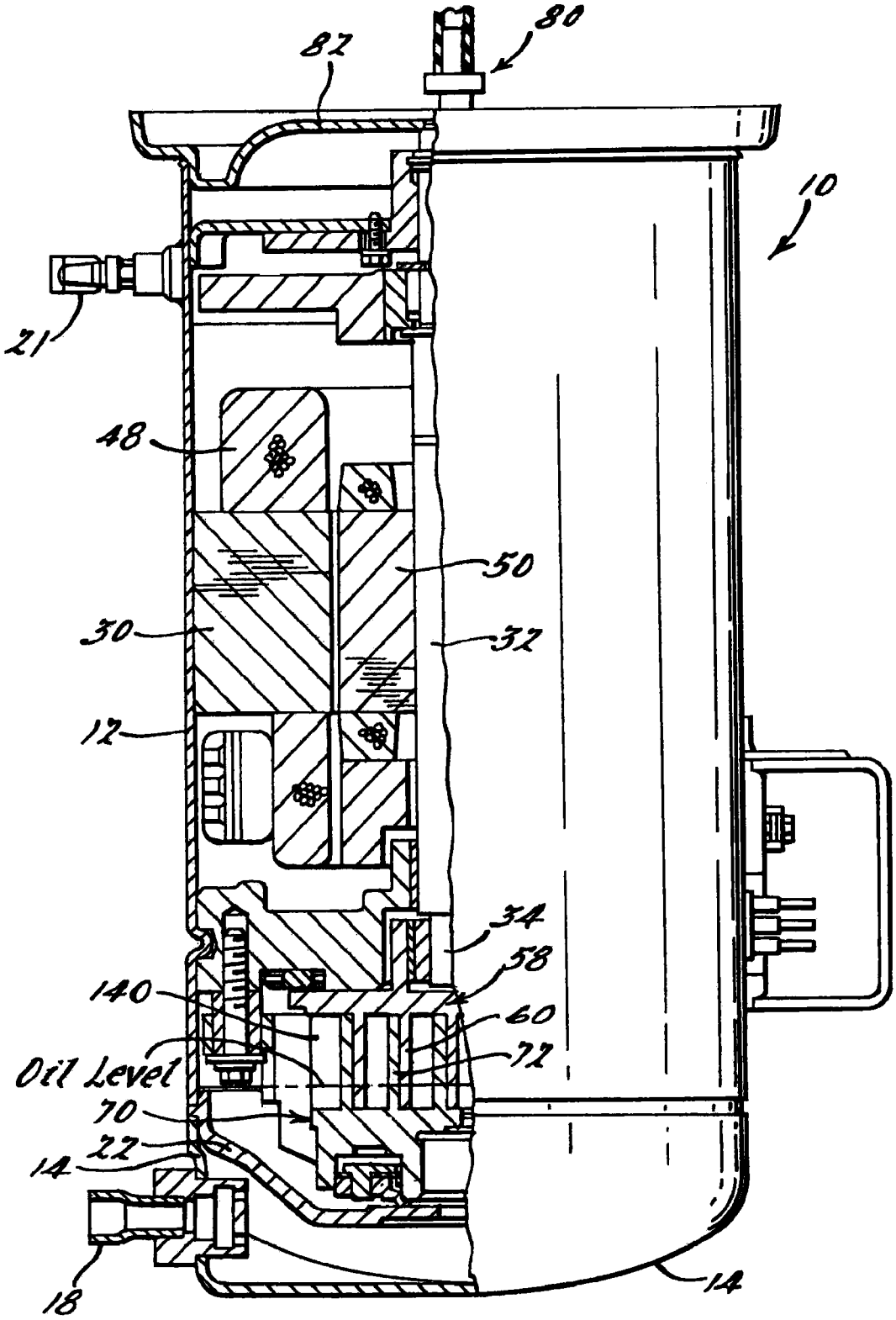
FIG. 6 is a vertical sectional view through the center of an inverted scroll compressor in accordance with the present invention.

As illustrated in FIG. 6, the scroll compressor can similarly be inverted so that the partition plate 22 is disposed at the bottom of the sump. The oil level can be maintained at or just above the lower edge of the gas inlet opening 140 of the scroll members 58, 70. Thus, a controlled amount of oil is received between the scroll wrap during operation of the scroll compressor utilized in the inverted position as illustrated in FIG. 6. In either the inclined or inverted positions, the amount of oil necessary to maintain the oil level at the gas inlet opening 140 can be minimized. Furthermore, the oil passing through the crankshaft and bearings and disposed in the sump also absorbs heat from the motor.

Figure 3:
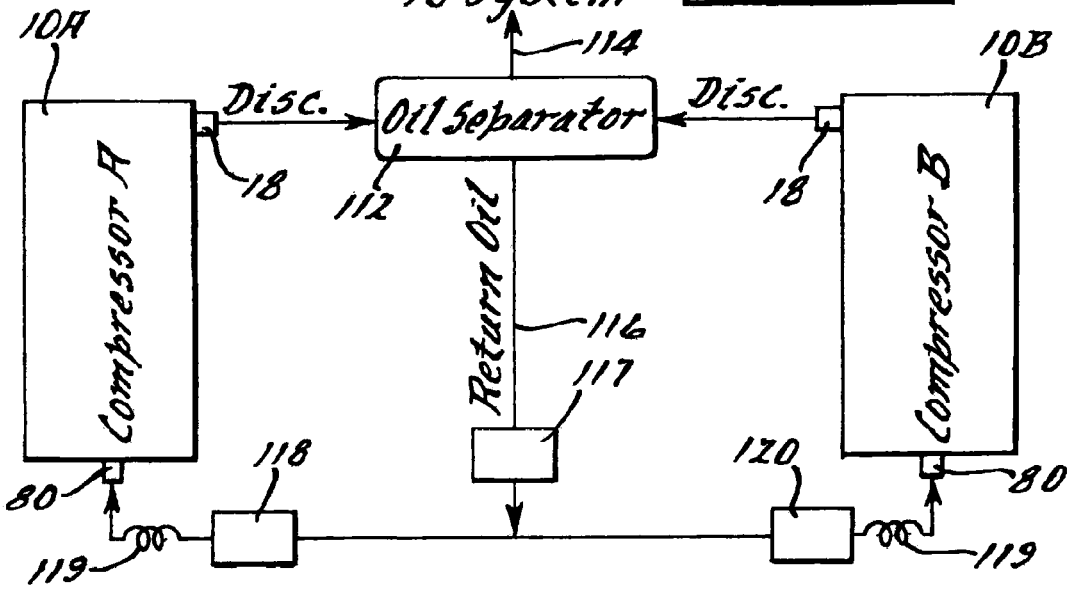
FIG. 3 is a schematic view of a system layout utilizing the negatively inclined scroll compressor with an oil injection fitting according to the principles of the present invention.

With reference to FIG. 3, a system layout is shown including two compressors 10A, 10B which are both preferably of the negatively inclined or inverted type shown in FIG. 1 or FIG. 6, respectively. The system is provided with an oil separator 112 which receives compressed gases from the discharge fittings 18 of compressors 10A, 10B. The oil separator 112 can be of any type known in the art. The oil separator 112 separates the oil from the discharge gases and provides the discharged gases via passage 114 to a desired system. A return oil passage 116 with a heat exchanger 117 is connected to the oil separator and communicates with a pair of electronic solenoids 118, 120. The electronic solenoids 118, 120 prevent loss of oil to the compressors from the separator after the compressors 10A, 10B are shut down due to pressure that is built up in the passage 114, oil separator 112, and return oil passage 116. As an alternative, the solenoid valves 118 can be eliminated if the discharge fitting 18 is not provided with a check valve. In that case, built-up pressure can be released back through the discharge fitting 18 which may result in reverse rotation of the compressor in which the pressure is relieved. In the case where a floating seal is provided, the floating seal is disengaged, thus, allowing the release of the pressure build-up. Capillary tubes 119 are provided to restrict flow to provide oil control to prevent excessive oil flow over the full operating range of the compressors 10A, 10B. The capillary tubes 119 can be used in addition to or as an alternative to the restriction oil passage 100 provided in the oil injection fitting 80. Oil is delivered through the fittings 80 and into the concentric bore provided in the crankshafts 32 of the compressors 10A, 10B. The concentric bore communicates with a radially outward smaller diameter bore extending therefrom to the second end of the crankshaft 32. From the second end of the crankshaft 32, oil is distributed to the bearings and to the scroll members 58, 70, as is known in the art.

Figure 4:
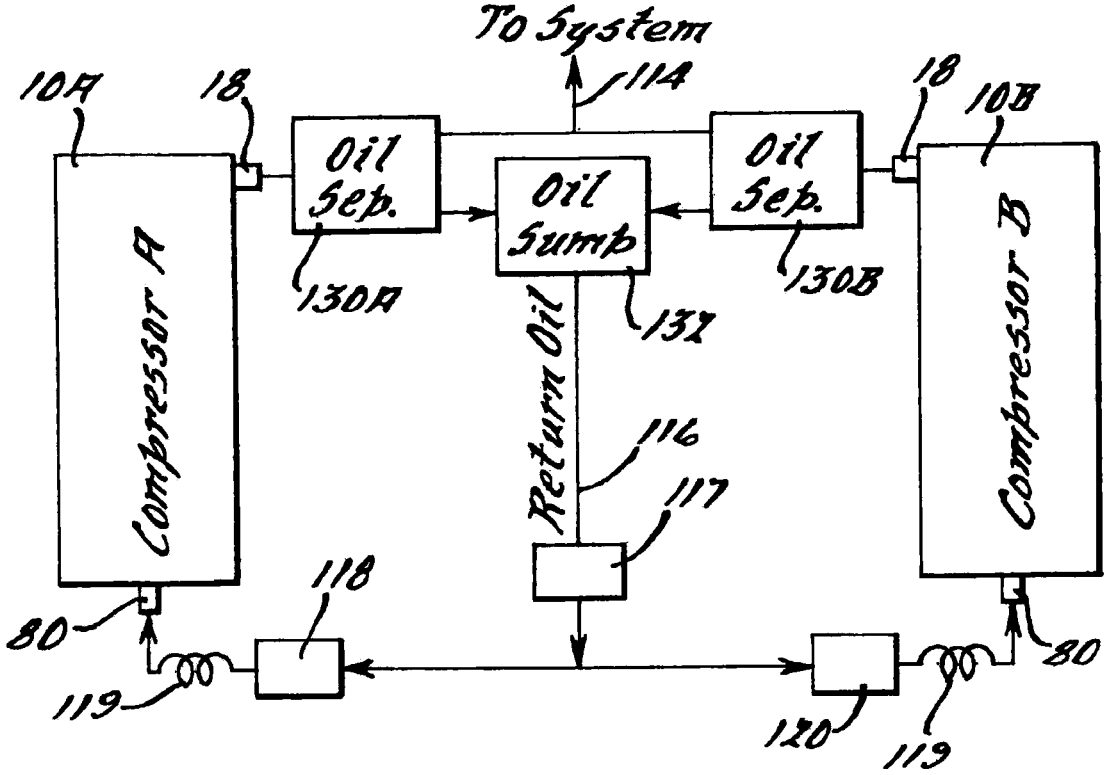
FIG. 4 is a schematic view of a system layout according to a second embodiment of the present invention.

FIG. 4 shows a system layout according to a second embodiment of the present invention. The system layout of FIG. 4 includes first and second compressors 10A, 10B which are provided with their own oil separators 130A, 130B, respectively. Each of the oil separators 130A, 130B are connected to a passage 114 for supplying discharge gases thereto. The oil separators 130A, 130B are connected to an oil sump 132 for providing the separated oil thereto. A return oil passage 116 with a heat exchanger 117 is connected to the oil sump 132 for returning oil to the first and second compressors 10A, 10B. It should be noted that the heat exchanger 117 can be provided upstream, downstream, or integral with the oil sump 132. Electronic solenoids 118, 120 are provided in the respective return oil passages connected to the compressors 10A, 10B. Again, capillary tubes 119 can be provided to restrict the oil flow to the oil injection fittings 80 of the compressors 10A, 10B. The system layout of FIG. 4 allows the use of standard oil separators and can be utilized with an air compressor or a natural gas compressor system.

Figure 5:
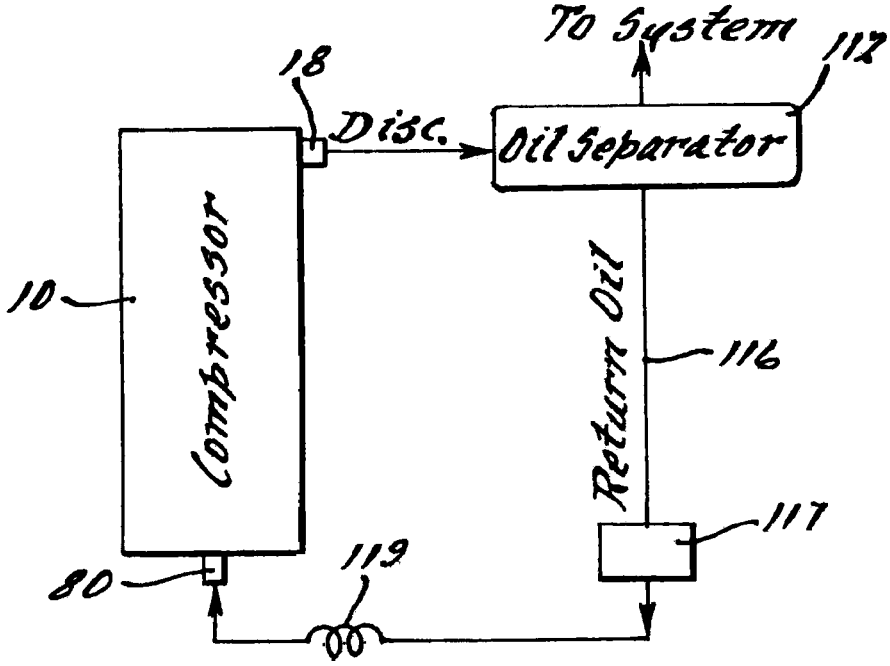
FIG. 5 is a schematic view of a system layout according to a third embodiment of the present invention.

FIG. 5 shows a single compressor system including a compressor 10 having a discharge passage 18 connected to an oil separator 112. An oil return passage 116 with a heat exchanger 117 is connected to the oil separator 112 for returning oil to the oil injection fitting 80 of the compressor 10. A capillary tube 119 is provided in the oil return passage 116 for restricting oil flow to the compressor. The capillary tube 119 can be used as an alternative or in addition to the restriction passage 100 provided in the oil injection fitting 80.

According to the present invention, a vertical-type compressor can be modified to become a negatively inclined compressor by adding an oil injection fitting and an external oil separator system. In addition, the modification of the vertical-type compressor to a negatively inclined compressor has a very low additional cost and has virtually the same performance as the vertical compressor being modified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scroll machine comprising:

a shell including a sidewall portion and a first end cap and a second end cap disposed at first and second ends of said sidewall portion, respectively;

a partition plate disposed in said shell for defining a discharge chamber between said partition plate and said first end cap and an intake chamber between said partition plate and said second end cap;

a first scroll member disposed within said shell, said first scroll member having a port and a first spiral wrap;

a second scroll member disposed within said shell and having a second spiral wrap, said first and second spiral wraps being mutually intermeshed;

a crankshaft drivingly attached to one of said first and second scroll members, said crankshaft including a lubrication passage extending therethrough;

a motor drivingly connected to said crankshaft for causing said one of said first and second scroll members to orbit with respect to the other of said scroll members, whereby upon orbiting of said one of said first and second scroll members said first and second spiral wraps define a gas inlet to at least one subsequently enclosed space of progressively changing volume between a peripheral zone defined by said scroll members and said port; and an oil injection fitting extending through said shell and communicating with said lubrication passage in said crankshaft, wherein under normal operating conditions said shell is positioned so that said first end cap is positioned vertically lower than said second end cap and said partition plate forms at least part of an oil sump within said intake chamber of said shell.

2. The scroll machine according to claim 1, wherein said oil injection fitting receives lubrication oil from an oil passage connected to an oil separator.

3. The scroll machine according to claim 1, wherein said sidewall portion of said shell is inclined at an angle relative to a horizontal plane.

4. The scroll machine according to claim 1, wherein said sidewall portion of said shell is vertical.

5. The scroll machine according to claim 1, wherein a portion of said first scroll member is disposed in said oil sump.

6. The scroll machine according to claim 1, wherein oil is provided in said oil sump at a level adjacent to said gas inlet.

7. The scroll machine according to claim 1, wherein said gas inlet is on a bottom side of said first and second scroll members.

8. The scroll machine according to claim 1, wherein said shell includes a discharge port extending therethrough in communication with said discharge chamber, said discharge port communicating with an oil separator wherein said oil injection fitting communicates with said oil separator.

9. The scroll machine according to claim 8, wherein discharge pressure is applied to said oil separator for supplying oil to said oil injection fitting.

10. The scroll machine according to claim 9, wherein said discharge port is open so as to allow backflow therethrough and a passage from said oil injection fitting to said oil separator remains constantly open.

* * * * *